United States Patent [19]

Stefanelli

[11] 4,454,950

[45] Jun. 19, 1984

[54] COLLAPSIBLE RECEPTACLE FOR STORAGE OF BULK ITEMS

[76] Inventor: Paul J. Stefanelli, 155 Burger Dr., Crownsville, Md. 21032

[21] Appl. No.: 332,193

[22] Filed: Dec. 18, 1981

[51] Int. Cl.[3] ..... A47F 5/10

[52] U.S. Cl. ..... 211/60 R; 211/49 R; 211/195

[58] Field of Search ..... 211/60 R, 50, 195, 72, 211/200, 85, 198, 49 R, 132; D6/184; 248/150, 152, 174; 312/330 SN, 296; 297/182

[56] References Cited

U.S. PATENT DOCUMENTS

| | | | |
|---|---|---|---|
| 507,233 | 10/1893 | Marshall | 211/85 |
| 777,211 | 12/1904 | Jones | 211/198 |
| 2,247,519 | 7/1941 | Pace | 211/49 R |
| 3,164,254 | 1/1965 | Gorc | 211/49 R X |
| 3,216,585 | 11/1965 | Whittle | 211/60 R |
| 3,255,989 | 6/1966 | Risk | 248/174 X |
| 3,447,677 | 6/1969 | Aitkens | 211/50 X |
| 3,606,950 | 9/1971 | Nevai | 211/195 X |
| 4,212,400 | 7/1980 | Buchsteiner | 211/200 X |

*Primary Examiner*—Ramon S. Britts
*Assistant Examiner*—Robert W. Gibson, Jr.
*Attorney, Agent, or Firm*—Schwartz, Jeffery, Schwaab, Mack, Blumenthal & Koch

[57] ABSTRACT

The collapsible receptacle includes first and second planar pieces pivotally connected together by a piano hinge, thus forming a V-shaped receiving section. A third piece cooperates with an extension of the first piece to form a U-shaped support base. A back piece is removably secured to the first and second piece, and the receiving section slopes toward the back piece so that debris is directed rearwardly. Finally, a chain is used to restrain the outward movement of the first and third pieces.

9 Claims, 5 Drawing Figures

COLLAPSIBLE RECEPTACLE FOR STORAGE OF BULK ITEMS

BACKGROUND OF THE INVENTION

1. Field of the Invention

The present invention relates to a collapsible receptacle for storage of bulk items and more particularly firewood.

2. Description of Relevant Art

Various types of firewood holders are and have been in use in the United States. Containers for firewood having U-shaped arms have also been described in U.S. Pat. Nos. 4,223,818 and 3,021,011.

U.S. Pat. No. 4,223,818 discloses curved members forming an open framework, the curved members being pivotally attached end-to-end. The rack, so formed, is capable of several open configurations suitable for containing wood. However, due to the curvature of the members comprising the rack, the rack cannot be made to assume a flat configuration for storage in a minimum of space.

U.S. Pat. No. 3,021,011 also discloses U-shaped members for containing a stack of firewood. The U-shaped members are rigidly fixed by fastening means to one side of a tray. Rigidly attached to the opposite side of the tray are other U-shaped members which include wheeled casters. It will be redily appreciated that the wheeled tray, while suited for containing wood, cannot be conveniently collapsed without substantially disassembling the whole apparatus. Of course, because the apparatus must be disassembled, parts may be more easily lost than with a more unitary structure.

U.S. Pat. Nos. 2,966,322 and 2,941,670 show racks and receptacles which can be collapsed or folded to facilitate storage.

SUMMARY OF THE INVENTION

Firewood has again become an important source of fuel and heat to many people who live in cooler winter climates. Free standing woodstoves, fireplace inserts, zero clearance fireplaces and chimneys and other improved woodburning systems are an integral part of new, retrofit, and remodled homes.

Along with the emmergence of wood as a winter fuel source, for various reasons, including energy conservation, building material costs and smaller family unit size, new residential structures generally have smaller floor plans and concomitantly smaller storage space. In these new, smaller homes, storage space is at a premium, and devices which can be compactly stored when not in use are highly desirable. Thus, a device which, during the winter, can contain a load of firewood either inside or immediately adjacent to an occupied structure and which can be conveniently stored in a minimum of space during the warmer months is highly desirable and useful.

It is an object of the instant invention to provide a storage receptacle for bulk items, particularly firewood, coal and the like.

Another object is to provide a bulk item receptacle which is easily stored when not in use.

A further object is to provide a bulk item receptacle which folds into a substantially planar configuration for storage in a minimum of floor or closet space.

It is a still further object to provide a receptacle for firewood which permits cleaner storage thereof by collecting debris falling from the wood in the bottom of the receptacle.

The instant invention relates to a device for the convenient storage of a load of firewood, or other bulk fuel. The invention contemplates a device which compactly stores a load of firewood or other bulk fuel and acts as a receptacle for debris such as woodchips, sawdust and the like which adhere to the wood when stored and dislodge from the wood when it is handled in preparation for burning. In addition to its wood storing and debris collection capabilities, the instant invention is also advantageously constructed to permit the apparatus to be "knocked-down" in a substantially planar configuration which is easily and conveniently stored using a mimimum of floor or closet space.

The collapsible receptacle includes first and second planar pieces pivotally connected together by a piano hinge, thus forming a V-shaped receiving secion. A third piece cooperates with an extension of the first piece to form a U-shaped support base. A back piece is removably secured to the first and second piece, and the receiving section slopes toward the back piece so that debris is directed rearwardly. Finally, a chain is used to restrain the outward movement of the first and third pieces.

BRIEF DESCRIPTION OF THE DRAWINGS

The foregoing and other objects and advantages of the invention will be understood more fully from the following description thereof with reference to the accompanying drawings, wherein.

DESCRIPTION OF THE PREFERRED EMBODIMENTS

Figure 1:
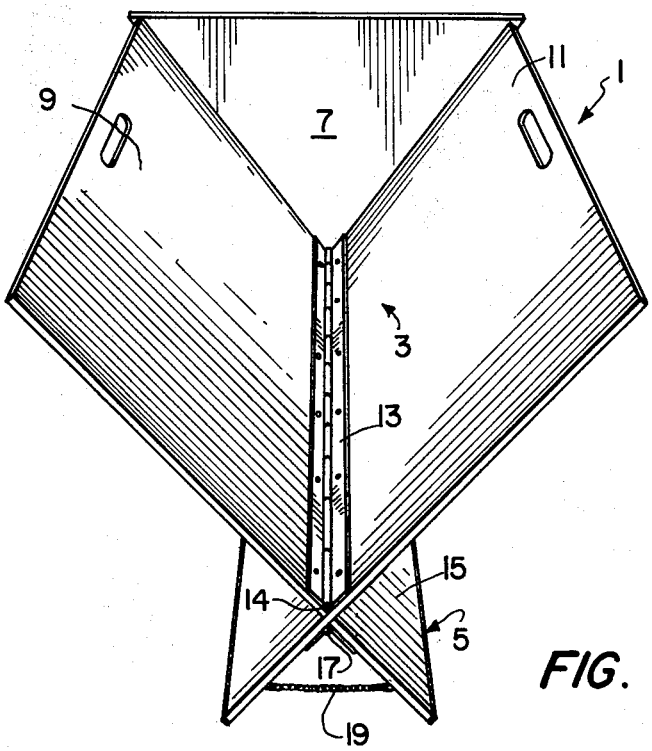
FIG. 1 is a front perspective view of the complete receptacle.
Figure 2:
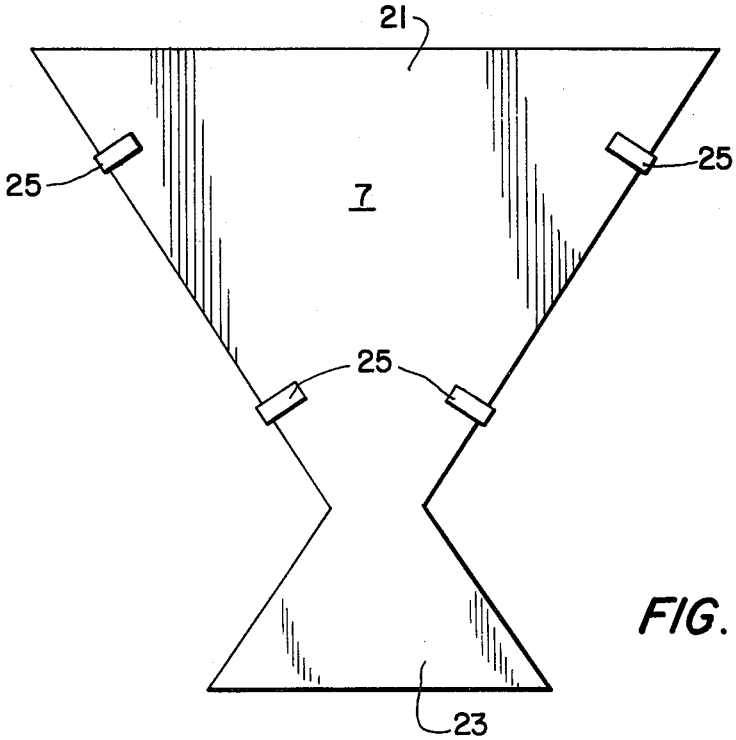
FIG. 2 is a view of the back piece.
Figure 3:
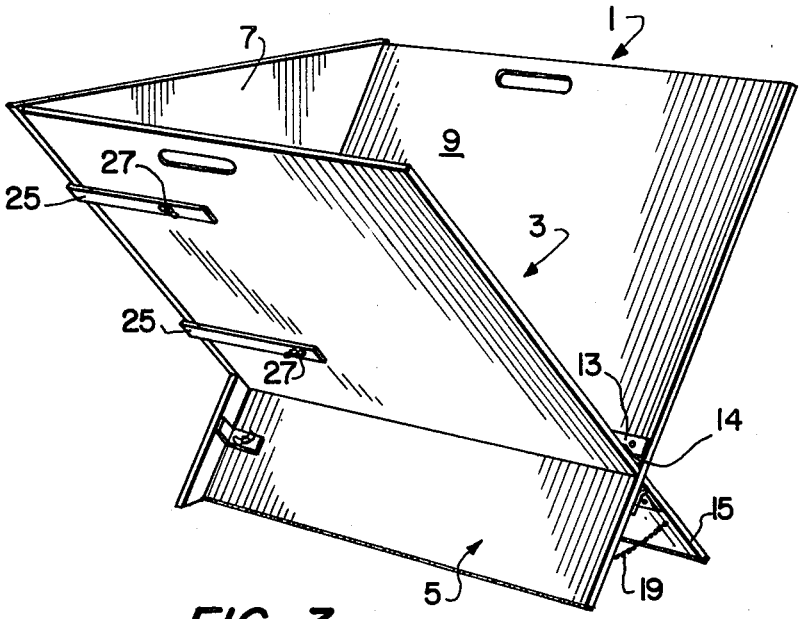
FIG. 3 is a left side perspective view of the complete apparatus.
Figure 4:
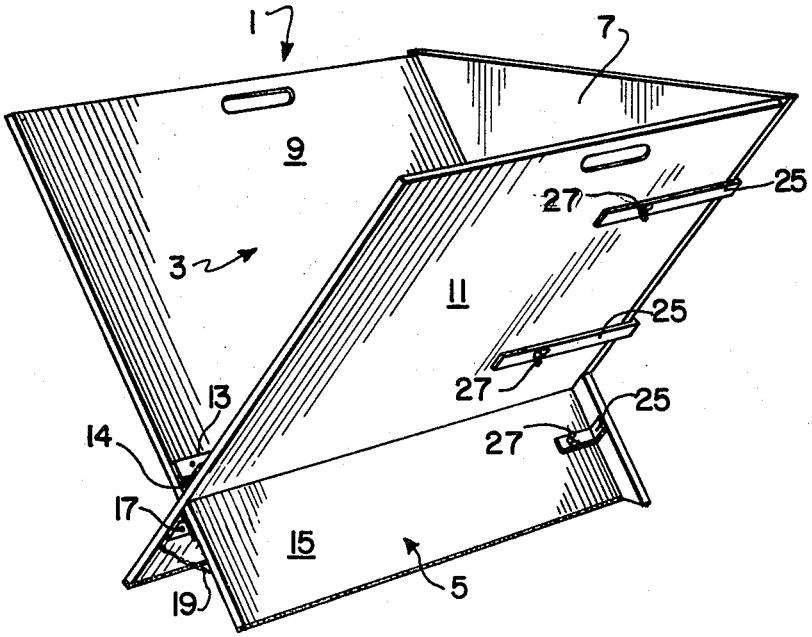
FIG. 4 is a right side perspective view of the apparatus.
Figure 5:
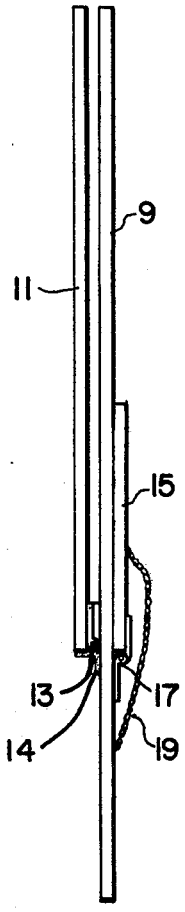
FIG. 5 is an end view of the collapsed receptacle.

As shown in the drawings, a storage device 1 has a large V-shaped receiving section 3 for the acceptance and storage of wood, a base 5 in the shape of an inverted V and a back piece 7.

The V-shaped receiving section is formed by a substantially planar first piece 9 and a shorter substantially planar second piece 11 pivotally attached to the upper surface of the longer fixed first piece 9. Preferably, the second piece 11 is attached by a hinge 13 to the fixed first piece 9 so that the relatively large, open receiving section 3 is formed.

The second piece 11 is attached to the first piece 9 by the piano hinge 13 at the inner angle of the apex of the V formed by the attachment of the first piece 9 and the second piece 11. In the preferred embodiment, a strip 14, which may be, for example, felt, is placed below the hinge 13 and between the edge of the second piece 11 and upper surface of the first piece 9 to prevent debris from falling through the hinge onto the floor. It will be readily appreciated that the piano hinge (4) may be replaced by a series of hinges and strips or by a flexible tape secured to the first and second pieces as a means for pivotally attaching the second piece to the first piece and preventing debris from falling through the receptacle to the floor.

The hinge 13 is parallel to the top edge, and the bottom piece 11 is cut shorter in the rear so that the unit is inclined rearwardly from the open front of the receiving section to the closed back piece 7. In this preferred embodiment, the rearward incline of the bottom of the receiving section 3 permits debris to accumulate toward the rear of the receiving section and thus permits wood to be stored and utilized more cleanly and with less debris falling out of the receptacle onto the floor.

Pivotally attached to the first piece 9 on the lower surface thereof, opposite the attachment of the second piece 11, is a third piece 15, which may be substantially planar. The third piece 15 is attached to the first piece 9 at a point on the lower surface thereof approximately opposite to the attachement of the second piece 11. The third piece 15 may be pivotally attached, for example by means of a series of hinges, secured flexible tape or in the preferred embodiment of a piano hinge 17.

It is desirable to restrict the movement of the third piece 15 by means secured between it and the first piece 9. In the preferred embodiment, the restricting means is a length of flexible chain 19, but it is readily apparent that the same restraint may be accomplished by use of, for example, cordage, a rod or a hook and eye fixed between the third piece 15 and the fixed first piece 9.

The first and second pieces are attached to the substantially planar back piece 7. The back piece 7 is substantially in the shape of a pair of V's 21 and 23 joined at their apecies. In the preferred embodiment of the upper V 21 is larger in width and height than the lower V 23. Attached to the edges of the back piece along the edges thereof are a plurality of retaining means which may conveniently be in the form of L-shaped brackets 25. The L-shaped brackets 25 are secured to the edges of the upper V of the back piece 7 by fastening means which, in the preferred embodiment, are thumbscrews 27. The fixed side piece 9 and movable side piece 11 are attached to the back piece 3 by the arms of the L-shaped brackets 27 and thumbscrews 27 to form the receptacle. The brackets can be removably or permanently attached to pieces 9 and 11 by conventional means including thumbscrews.

It will be readily apparent that the receptacle may be used for a variety of storage purposes including, for example, firewood, soft coal, hard coal and other solid bulk fuels commonly found inside the home for use in a fireplace, woodstove, water heater or furnace.

It will also be apparent to those skilled in the art that the receptacle as herein described may be construed of a variety of sheet materials, including wood and wood laminates, plate metal, plastic and other materials which are commonly produced in substantially planar configuration.

While several embodiments of the invention have been described, it will be understood that it is capable of still further modifications and this application is intended to cover any variations, uses, or adaptions of the invention, following in general the principles of the invention and including such departures from the present disclosure as to come within knowledge or customary practice in the art to which the invention pertains, and as may be applied to the essential features hereinbefore set forth and falling within the scope of the invention of the limits of the appended claims.

I claim:

1. A collapsible receptacle for bulk items comprising:

(a) a substantially planar first piece of sheet material having an upper side and a lower side;

(b) a substantially planar second piece of sheet material;

(c) a first hinge means attaching an edge of said second piece substantially across said upper side of said first piece whereby said first and second piece form a substantially V-shaped receiving section;

(d) a substantially planar third piece of sheet material having a pair of ends;

(e) a second hinge means attaching an end of said third piece to said lower side of said first piece whereby said first and said third piece form a substantially V-shaped base, said V-shaped receiving section being substantially larger than said V-shaped base;

(f) a substantially planar closed back piece of sheet material having an upper V-shaped portion and a lower inverted V-shaped portion conforming to said V-shaped receiving section and said V-shaped base, respectively, and means for removably fastening said back piece to said substantially V-shaped receiving section, whereby said V-shaped receiving section has an open front and a closed back.

2. The collapsible receptacle defined in claim 1 wherein said first hinge means is a piano hinge.

3. The collapsible receptacle defined in claim 1, including means to restricting extension of said third piece relative to said first piece.

4. The collapsible receptacle defined in claim 3 wherein means for restricting extension is a flexible chain secured between the lower surface of said first piece and third piece.

5. The collapsible receptacle defined in claim 1 wherein said second hinge means is a piano hinge.

6. A collapsible receptacle for bulk items comprising:

(a) a substantially planar first piece of sheet material having an upper side and a lower side;

(b) a substatially planar second piece of sheet material;

(c) a first hinge means attaching an edge of said second piece substantially across said upper side of said first piece whereby said first and second piece form a substantially V-shaped receiving section;

(d) a substantially planar third piece of sheet material having a pair of ends;

(e) a second hinge means attaching an end of said third piece to said lower side of said first piece whereby said first and said third piece form a base;

(f) a strip of material being placed below said first hinge means between said edge of said second piece and said upper surface of said first piece whereby small pieces of bulk items stored in said receptacle are prevented from falling through said first hinge means;

(g) a substantially planar back piece of sheet material, and means for removably fastening said back piece to said substantially V-shaped receiving section; and (h) said V-shaped receiving section being inclined downwardly toward said back piece whereby debris will accumulate toward said back piece.

7. The collapsible receptacle defined in claim 6 wherein said strip is felt.

8. A collapsible reeceptacle for bulk items comprising:

(a) a substantially planar first piece of sheet material having an upper side and a lower side;

(b) a substantially planar second piece of sheet material;

(c) a first hinge means attaching an edge of said second piece substantially across said upper side of said first piece whereby said first and second piece form a substantially V-shaped receiving section;

(d) a substantially planar third piece of sheet material having a pair of ends;

(e) a second hinge means attaching an end of said third piece to said lower side of said first piece whereby said first and said third piece form a base;

(f) a substantially planar back piece of sheet material, and means for removably fastening said back piece to said substantially V-shaped receiving section, said means for fastening said back piece being a plurality of substantially L-shaped brackets secured to said back piece and said substantially V-shaped receiving section.

9. The collapsible receptacle defined in claim 8 wherein said substantially L-shaped brackets are secured by thumbscrews.

* * * * *